US007543555B2

(12) United States Patent
Genise

(10) Patent No.: US 7,543,555 B2
(45) Date of Patent: Jun. 9, 2009

(54) HYDRAULIC LASH COMPENSATION DEVICE WITH MECHANICAL LIFT LOSS FEATURE

(75) Inventor: David G. Genise, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 81 days.

(21) Appl. No.: 11/832,033

(22) Filed: Aug. 1, 2007

(65) Prior Publication Data

US 2009/0031976 A1 Feb. 5, 2009

(51) Int. Cl.
*F01L 1/14* (2006.01)

(52) U.S. Cl. ..... 123/90.52; 123/90.45; 123/90.46

(58) Field of Classification Search ... 123/90.43–90.46, 123/90.52, 90.55, 90.57
See application file for complete search history.

(56) References Cited

U.S. PATENT DOCUMENTS 5,758,613 A * 6/1998 Edelmayer et al. ..... 123/90.35
6,039,017 A 3/2000 Hendriksma
6,192,845 B1 2/2001 Guzak

* cited by examiner

*Primary Examiner*—Zelalem Eshete
(74) *Attorney, Agent, or Firm*—Anna M. Shih

(57) ABSTRACT

A hydraulic lash compensation device for an engine includes a plunger assembly slidingly received within a body bore to define a high pressure chamber. The plunger assembly includes a lower pressure chamber, an upper plunger element, and a lower plunger element. A mechanical lift loss feature includes a generally annular lift stop member retained to the upper plunger element by an adjustment member that extends through the lift stop member and is adjustably received in upper plunger element. The lift stop member is biased away from upper plunger element by a spring. When the upper plunger element is received into the body, the upper plunger element is offset a predetermined distance from the lower plunger element by virtue of the lift stop member's engagement with the lower plunger element. The offset is adjustable based on the position of the lift stop member relative to the upper plunger element.

6 Claims, 2 Drawing Sheets

HYDRAULIC LASH COMPENSATION DEVICE WITH MECHANICAL LIFT LOSS FEATURE

BACKGROUND OF THE DISCLOSURE

The present invention relates generally to hydraulic lash compensation devices, such as hydraulic lash adjusters (HLA), and more particularly to a hydraulic lash compensation device of the type in which there is both a high pressure chamber and a reservoir or low pressure chamber.

Hydraulic lash adjusters (also sometimes referred to as "lifters") for internal combustion engines have been in use for many years to eliminate clearance, or lash, between engine valve train components under varying operating conditions to maintain efficiency and to reduce noise and wear in the valve train. Hydraulic lash adjusters operate on the principle of transmitting the energy of the valve actuating cam through hydraulic fluid, which is trapped in a pressure chamber under a plunger. During each operation of the cam, as the length of the valve actuating components varies as a result of temperature changes and wear, small quantities of hydraulic fluid are permitted to enter the pressure chamber, or escape therefrom, thus effecting an adjustment in the position of the plunger, and consequently adjusting the effective total length of the valve train.

The cam operating cycle comprises two distinct events; (1) operation on the base circle and (2) valve actuation. The base circle event is characterized by a constant radius between the cam center of rotation and the cam follower, and during this event, no cam energy is transmitted. The valve actuation event is characterized by a varying radius between the cam center of rotation and the cam follower, which effectively transmits cam energy to open and close an engine valve. During the valve actuation event, a portion of the load resulting from the valve spring, the inertia of valve train components, and cylinder pressure are transmitted through the valve train and through the lash adjuster. The load increases the pressure of the hydraulic fluid within the lash adjuster pressure chamber, in proportion to the plunger area, and in typical hydraulic lash adjusters currently in commercial production, fluid escapes the pressure chamber between the plunger and the wall of the lash adjuster body. Such a device is referred to as a "conventional leakdown" lash adjuster. Although the present invention could be utilized in various types of hydraulic lash adjusters, it is especially adapted for use in an HLA of the conventional leakdown type, and will be described in connection therewith.

There have been proposed lash adjusters which provide "lift loss," that is, lash adjusters which are capable of shrinking to a certain extent before the sealed high-pressure chamber prevents further movement. Thus, there is a degree of lost motion of the lash adjuster before the valve starts to open. This lost motion is recovered by a spring after the valve has closed. Using such a lash adjuster, a small degree of negative lash can be quickly accommodated by the lost motion of the lash adjuster, thus making it more certain that the valve will close. Previously proposed "lift loss" lash adjusters have required significant modification to more traditional lash adjuster designs and require select fitting of precisely machined components to adjust the desired amount of lift loss.

BRIEF SUMMARY OF THE INVENTION

A hydraulic lash compensation device for an internal combustion engine is provided that includes a body defining a bore therein and a fluid port in communication with a source of fluid pressure. A plunger assembly is slidingly received within the bore and cooperates with the bore to define a high pressure chamber. The plunger assembly includes a lower pressure chamber, an upper plunger element adapted for engagement with an adjacent surface of a valve train component, and a lower plunger element. The bore and the lower plunger element cooperate to define a leakdown clearance providing fluid communication between the high pressure chamber and the low pressure chamber. A plunger spring normally urges the plunger assembly outward of the bore.

The hydraulic lash adjuster according to the present invention also includes a mechanical lift loss feature including a generally annular lift stop member retained to the upper plunger element by an adjustment member that extends unencumbered through the lift stop member and is adjustably secured to the upper plunger element. The lift stop member is biased away from the upper plunger element by a lash spring. When the upper plunger element is received into the body, upper plunger element is offset a predetermined distance from the lower plunger element by virtue of the lift stop member's engagement with the lower plunger element. The offset is adjustable based on the position of the lift stop member relative to the upper plunger element.

DETAILED DESCRIPTION

Figure 1:
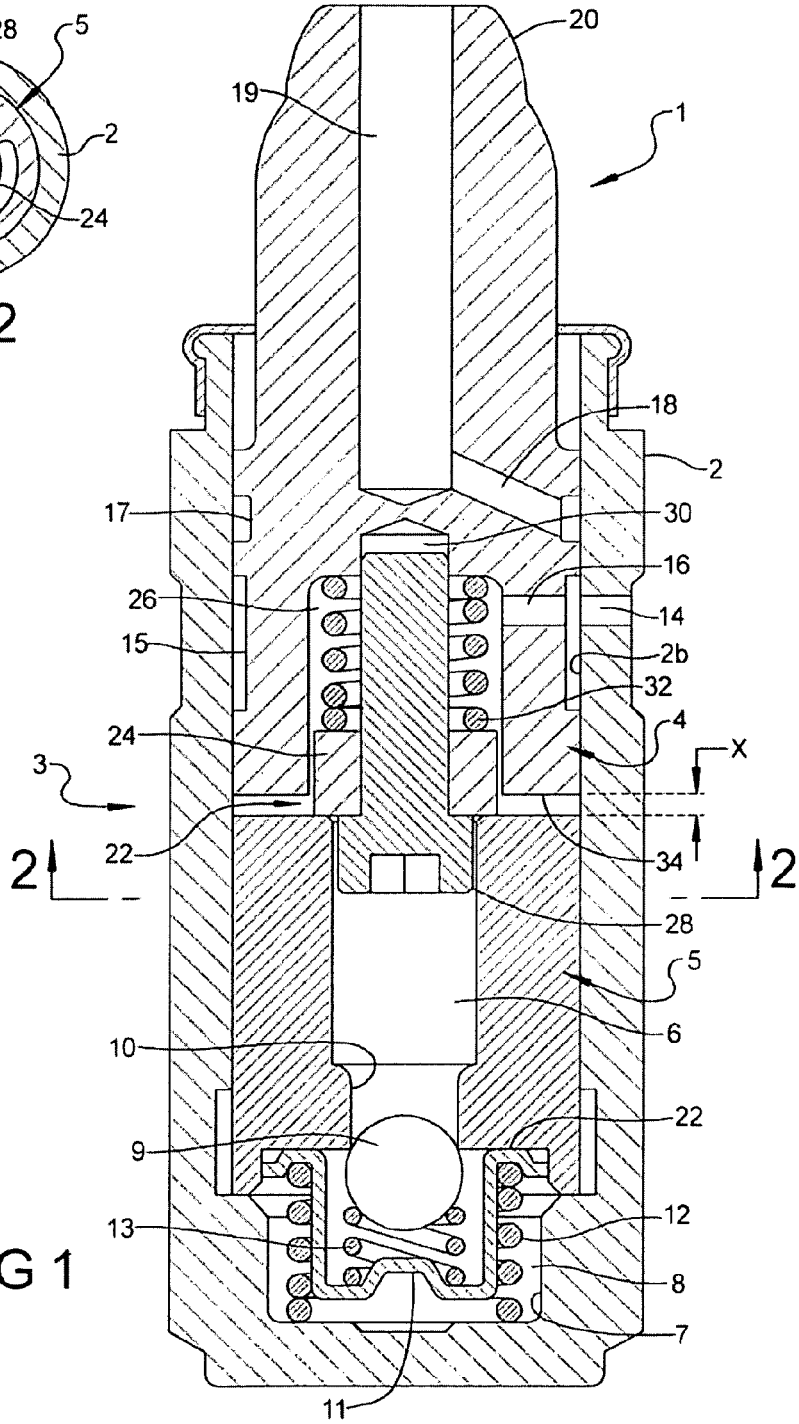
FIG. 1 is a longitudinal cross section through a hydraulic lash adjuster according to an embodiment of the invention.

Referring now to the drawings, which are not intended to limit the invention, FIG. 1 illustrates a hydraulic lash adjuster 1 having a body 2, and a plunger assembly, generally designated 3, which is slidingly disposed within the body 2. The plunger assembly 3 includes an upper plunger element 4 and a lower plunger element 5. The plunger elements 4 and 5 are received within the body in a close fitting relationship within a bore 2*b* of the body 2. The upper and lower plunger elements 4 and 5 define a low pressure chamber (reservoir) 6 between them. The bottom of the lower plunger element 5 forms, in cooperation with the end of a reduced diameter portion 7 of the body bore 2*b*, a high pressure chamber 8. A check valve 9 is disposed in the end of a passage 10 which connects the high pressure chamber 8 and the low pressure chamber 6.

In the illustrated embodiment, the check valve 9, which is shown as a ball by way of example only, but which can also be a fiat disk or the like, is retained by a cage 11 that is in an interference fit within a counterbore 22 formed in the lower plunger element 5. The cage 11 provides a seat for a lash adjuster plunger spring 12 in accordance with the common design practice, there is shown in. FIG. 1 a bias spring 13, acting between the bottom of the cage 11 and the check ball 9, biasing the check ball into a normally closed position. However, various other check ball biasing arrangements are known, and it should be understood that the present invention is not limited to any particular check valve configuration or arrangement for biasing the check valve. Furthermore, the check valve could be positioned to be "free" and not be biased in any direction.

An oil entry port 14 opens into the bore 2*b* of the body 2 and intersects a collector groove 15 which, in turn, intersects a radial port 16 in the upper plunger element 4, to supply hydraulic fluid from a source (not shown herein) to the low pressure chamber 6. A second collector groove 17 and a port (or passage) 18 in the upper plunger element 4 provide metered hydraulic fluid to an axial meter passage 19, to supply lubricant to an adjacent surface of a rocker arm (not shown). Typically, the surface of the rocker arm would engage a ball plunger element 20 formed on the upper end of the upper plunger element 4.

Figure 2:
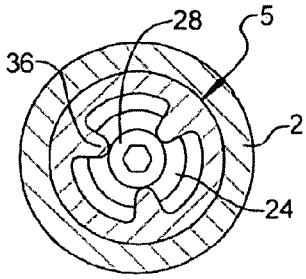
FIG. 2 is a cross-sectional view of the hydraulic lash adjuster of FIG. 1 taken along line 2-2.

Upper plunger element 4 also includes a mechanical lift loss feature 22. In an embodiment of the invention, the lift loss feature 22 includes a generally annular lift stop member 24 positioned in an inner cavity 26 of the upper plunger element 4. The lift stop member 24 is retained to the upper plunger element 4 by an adjustment member 28, such as an Allen screw, which extends unencumbered through the lift stop member 24 and is threaded into a threaded port 30 in the inner cavity 26. The lift stop member 24 is biased away from upper plunger element 4 by a lash spring 32 that is sized so that the initial installed preload is greater than the maximum force of the plunger spring 12 by a predetermined amount. The extent to which lift stop member 24 extends beyond a distal end 34 of the upper plunger element 4 is variable and based on the extent to which adjustment member 28 is threaded into the port 30. As shown in FIG. 2, the lower plunger element 5 may be configured with a number of radially inwardly extending ribs 36 upon which the lift stop member 24 is supported, but allow oil to pass from the cavity 26 into the low pressure chamber 6.

Adjustment member 28 and upper plunger element 4 may have fine threads, such as M3 threads, to permit very precise adjustment of the position of the adjustment member 28. When upper plunger element 4 is received into the body 2, the distal end 34 is offset a predetermined distance "X"—known as the "lash offset"—from the lower plunger element 5 by virtue of the lift stop member's engagement with the lower plunger element 5. The lash offset may be adjusted by turning the adjustment member 28 prior to assembly to set the desired amount of lift-loss, which in an embodiment of the invention, is approximately 0.1-0.3 mm.

In operation in an engine valve train (not shown), oil supplied to the cavity 26 of the upper plunger element 4 fills the low pressure chamber 6 of the lower plunger element 5 and is forced through the check valve controlled passage 10 into the high pressure chamber 8, which is normally filled with oil at engine oil pressure. The check valve 9 closes the passage 10 to prevent the escape of oil through the passage. When the associated engine valve (not shown) begins to open, load applied to the upper plunger element 4 is transferred through the assembly to the lower plunger 5 compressing the oil in the high pressure chamber 8 in proportion to the load applied. Compressed oil supports the upper and lower plunger elements 4, 5. When the downward force on the upper plunger element 4 exceeds the preload of the lash spring 32, the lash spring begins to compress thereby closing the lash offset and causing the upper and lower plunger elements 4, 5 to be forced into solid engagement. Thereafter, the finger follower loads the upper and lower plunger elements 4, 5 downwardly, increasing the oil pressure in the high pressure chamber 8. The check valve 9 closes the passage 10 to prevent the escape of oil through the passage and the compressed oil supports the upper and lower plunger elements 4, 5 to provide the needed reaction pivot required for opening of the associated valve further.

During the valve opening event, the pressure in the high pressure chamber 8 is significantly increased in order to support the load imposed by the valve train. Since oil cannot escape from the high pressure chamber 8 through the passage 10, which is blocked by the check valve 9, a certain amount of oil is forced through the radial clearance between the lower plunger element 5 and the body 2 up to the inlet opening 14 and the associated recesses where it re-circulates into the cavity 26. This causes a small reduction in the volume of the high pressure chamber 8, which is limited by the close clearance between the lower plunger element 5 and the body 2, but is necessary for the proper operation of the lash adjuster 1.

When the valve is again closed, the load on the system is removed, and the hydraulic lash adjuster extends to eliminate any lash in the system. First, the lash spring 32 exerts a greater force than the plunger spring 12, so that the lash spring 32 again separates the plunger and piston, reinstating the mechanical lash offset clearance 22 previously referred to. Next, the plunger spring 12 forces the plunger elements 4, 5 upwardly, causing the pressure in the high pressure chamber 8 to be reduced and allowing oil follow from the low pressure chamber 6 and the cavity 26 into the high pressure chamber 8 to make up for the oil lost during the previous valve opening event. This continues during operation of the finger follower on the base circle of the associated cam until the lash created in the valve train by the escape of oil from the high pressure chamber is taken up.

Thus, when the cam again reaches the point of opening of the associated valve, the mechanical lash offset is again closed first before contact of the upper and lower plunger elements 4, 5 occurs and the combination becomes a solid pivot for opening the valve against the force of the still stronger valve spring (not shown).

When the engine is being started, or operated under extremely cold conditions, a relatively quick heating of the exhaust valves may cause rapid growth in the reaction length of the valve train which exceeds the ability of the highly viscous cold oil to leak out from the high pressure chamber 8 through the clearances around the lower plunger element 5 during the time when the valve is held open. In this instance, there may be negative lash in the system except for the initial lash offset which is made large enough to accommodate any anticipated thermal growth in the valve train as a result of the rapid thermal growth of the valves. The lash offset will be reduced as long as the growth of the exhaust valves exceeds the leakage rate of oil from the lash adjuster. However, this condition will be reversed by warming of the oil which allows the leakage to increase until normal conditions return and the lifter is again allowed to shorten a sufficient amount during the valve open periods to offset the growth that occurred in the length of the valve train during the warm-up period. Thus, the valve will never be held open by thermal growth, or retention of oil in the lash adjuster which exceeds the rate of growth of the associated exhaust valve and the associated portions of the valve train.

Figure 3:
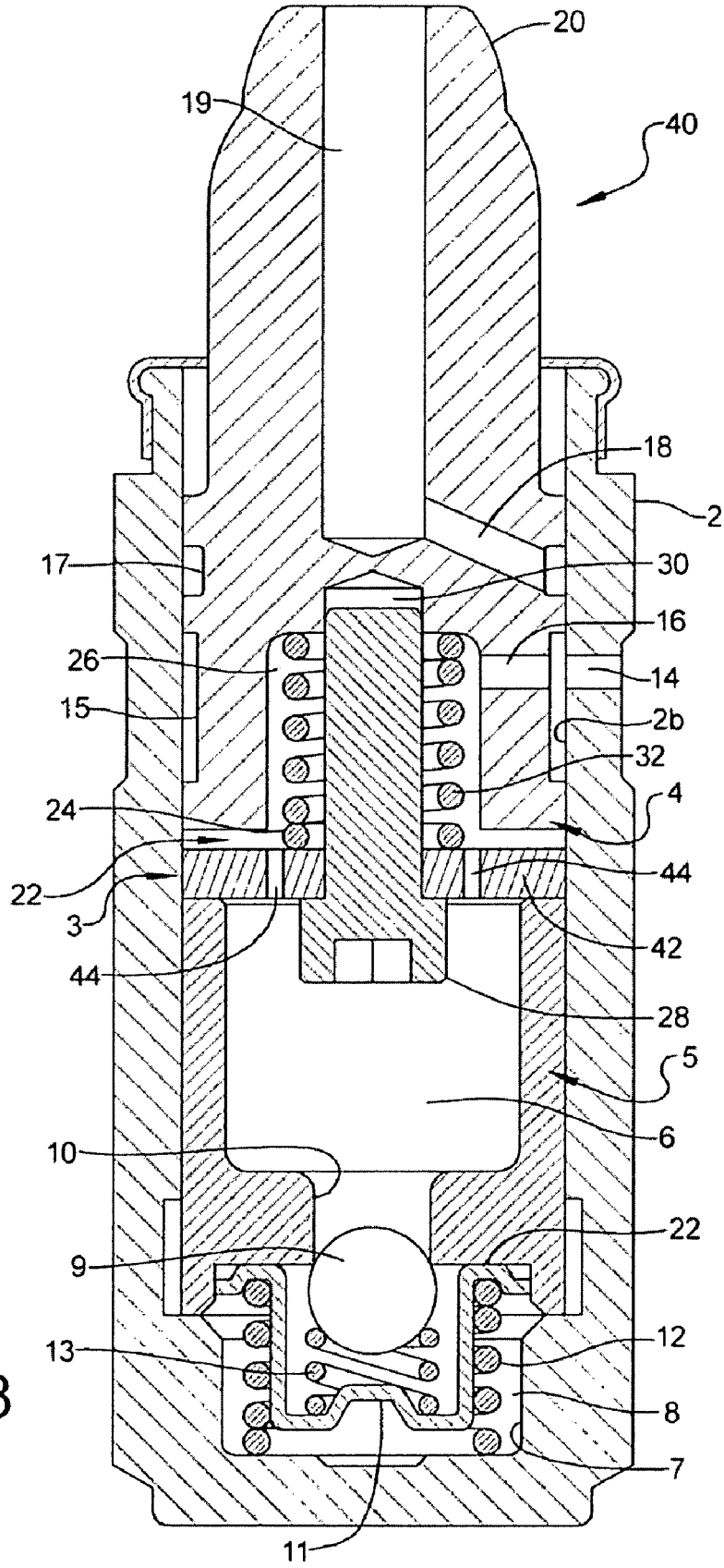
FIG. 3 is a longitudinal cross section through a hydraulic lash adjuster according to another embodiment of the invention.

Referring now to FIG. 3, numeral 40 generally indicates a second embodiment of hydraulic lash adjuster according to the invention. Lash adjuster 40 is generally similar to the embodiment of FIG. 1, so that like numerals are used to indicate like parts. The lift loss feature 22 includes a generally annular lift stop member 42 positioned adjacent the upper plunger element 4. The lift stop member 42 is retained to the upper plunger element 4 by an adjustment member 28, such as an Allen screw, which extends unencumbered through the lift stop member 42 and is threaded info a threaded port 30 in the inner cavity 26. The lift stop member 42 is biased away from upper plunger element 4 by a lash spring 32 that is sized so that the initial installed preload is greater than the maximum force on the plunger spring 12 by a predetermined amount. The extent to which lift stop member 42 is spaced from a distal end 34 of the upper plunger element 4 is variable and based on the extent to which adjustment member 28 is threaded into the port 30. As shown in FIG. 3, the lift stop member 42 may be configured with at least one passage 44 that extends entirely therethrough to allow oil to pass from the cavity 26 into the low pressure chamber 6. Operation of hydraulic lash adjuster 40 is substantially similar to hydraulic lash adjuster 1.

While the present invention has been described and illustrated as being embodied in a hydraulic lash adjuster, it is not intended to be limited thereto. Accordingly, the present invention may be embodiment in other hydraulic lash compensation devices, including., without limitation, bucket tappets and roller followers.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic lash compensation device for an internal combustion engine, the hydraulic lash compensation device comprising:

a body defining a bore therein and a fluid port in communication with a source of fluid pressure;

a plunger assembly slidingly received within the bore and cooperating with the bore to define a high pressure chamber, the plunger assembly including a lower pressure chamber, an upper plunger element adapted for engagement with an adjacent surface of a valve train component, and a lower plunger element, the bore and the lower plunger element cooperating to define a leakdown clearance providing fluid communication between the high pressure chamber and the low pressure chamber;

a plunger spring normally urging the plunger assembly outward of the bore; and a mechanical lift loss feature including a generally annular lift stop member retained to the upper plunger element by an adjustment member that extends unencumbered through the lift stop member and is adjustably secured to the upper plunger element, the lift stop member is biased away from the upper plunger element by a lash spring, wherein when the upper plunger element is received into the body, the upper plunger element is offset a predetermined distance from the lower plunger element by virtue of the lift stop member's engagement with the lower plunger element, and wherein the offset is adjustable based on the position of the lift stop member relative to the upper plunger element.

2. The hydraulic lash compensation device of claim 1, wherein at least a portion of the lift stop member is received within the upper plunger element and variably extends beyond a distal end of the upper plunger element based on the extent to which the adjustment member is threaded into the port.

3. The hydraulic lash compensation device of claim 1, wherein the lower plunger element includes a number of radially inwardly extending ribs upon which the lift stop member is supported to allow oil to pass into the low pressure chamber.

4. The hydraulic lash compensation device of claim 1, wherein the lift stop member is positioned adjacent the upper plunger element and includes at least one passage that extends entirely therethrough to allow oil to pass into the low pressure chamber.

5. The hydraulic lash compensation device of claim 1, wherein the lash spring is sized so that an initially installed preload is greater than the maximum force of the plunger spring by a predetermined amount to account for the additional force present on the bottom plunger due to engine oil pressure.

6. The hydraulic lash compensation device of claim 1, wherein the lift stop member is threaded into a threaded port in the upper plunger element, and the offset is adjustable based on the extent to which the adjustment member is threaded into the threaded port.

* * * * *